US012378961B2

(12) United States Patent
Müller et al.

(10) Patent No.: US 12,378,961 B2
(45) Date of Patent: Aug. 5, 2025

(54) SCREW PUMP WITH A TAPERED SUCTION-SIDE SECTION AND A PRESSURE-SIDE SECTION WITH A DECREASING CLEARANCE

(71) Applicant: Leybold GmBH, Cologne (DE)

(72) Inventors: Roland Albert Müller, Cologne (DE); David Thomas Chrisp, Cologne (DE)

(73) Assignee: Leybold GmBH, Cologne (DE)

( * ) Notice: Subject to any disclaimer, the term of this patent is extended or adjusted under 35 U.S.C. 154(b) by 0 days.

(21) Appl. No.: 18/576,066

(22) PCT Filed: Jul. 5, 2022

(86) PCT No.: PCT/EP2022/068607

§ 371 (c)(1),
(2) Date: Jan. 2, 2024

(87) PCT Pub. No.: WO2023/280865

PCT Pub. Date: Jan. 12, 2023

(65) Prior Publication Data

US 2024/0328419 A1 Oct. 3, 2024

(30) Foreign Application Priority Data

Jul. 8, 2021 (GB) ..... 2109851

(51) Int. Cl.
*F04C 18/16* (2006.01)
*F04C 23/00* (2006.01)
*F04C 25/02* (2006.01)

(52) U.S. Cl.
CPC ..... *F04C 18/16* (2013.01); *F04C 18/165* (2013.01); *F04C 23/005* (2013.01); *F04C 25/02* (2013.01);

(Continued)

(58) Field of Classification Search
CPC .... F04C 2/16; F04C 2/165; F04C 18/16–165; F04C 25/02; F04C 23/005; F04C 23/006; F04C 2230/602
See application file for complete search history.

(56) References Cited

U.S. PATENT DOCUMENTS 4,792,294 A 12/1988 Mowli
6,672,855 B2 * 1/2004 North ..... F04C 18/084 418/9

(Continued)

FOREIGN PATENT DOCUMENTS

BE 1009829 A3 10/1997
CN 105971877 A 9/2016

(Continued)

OTHER PUBLICATIONS

Combined Search and Examination Report from GB application No. 2109851.2, dated Dec. 9, 2021, 6 Pages.

(Continued)

*Primary Examiner* — Laert Dounis
(74) *Attorney, Agent, or Firm* — Shumaker & Sieffert, P.A.

(57) ABSTRACT

A screw pump comprising a housing defining a chamber and two screw rotors. Wherein each screw rotor comprises a rotor shaft and at least two displacement elements connected with the rotor shaft. Each displacement element having at least one helical protrusion. One of the displacement elements is a suction-side displacement element arranged in a suction-side section of the chamber. Another one of the displacement elements is a pressure-side displacement element arranged in a pressure-side section of the chamber. The suction-side displacement element is designed tapering in the conveying direction. The clearance between the pressure-side displacement element and the pressure-side section of the chamber at least partly decreases in the conveying (Continued)

direction. Furthermore, a screw rotor, a method of manufacturing a screw rotor and a use of a screw pump or a screw rotor.

21 Claims, 9 Drawing Sheets

(52) U.S. Cl.
CPC .... *F04C 2230/10* (2013.01); *F04C 2230/602* (2013.01); *F04C 2270/17* (2013.01)

(56) References Cited

U.S. PATENT DOCUMENTS

| | | | | |
|---|---|---|---|---|
| 2018/0258934 | A1* | 9/2018 | Gray | F04C 18/084 |
| 2020/0325897 | A1 | 10/2020 | Dreifert et al. | |

FOREIGN PATENT DOCUMENTS

| | | | | | |
|---|---|---|---|---|---|
| CN | 106401947 | A | * | 2/2017 | F04C 13/001 |
| DE | 202017005336 | U1 | | 1/2019 | |
| EP | 0104265 | A1 | | 4/1984 | |
| GB | 968195 | | | 8/1964 | |
| JP | S59208077 | A | | 11/1984 | |
| JP | H06117386 | A | | 4/1994 | |
| JP | H109163 | A | | 1/1998 | |
| JP | 2016196859 | A | | 11/2016 | |
| JP | 2020537084 | A | | 12/2020 | |

OTHER PUBLICATIONS

International Search Report and Written Opinion of International Application No. PCT/EP2022/068607, dated Oct. 20, 2022, 12 Pages.

Office Action, and translation thereof, from counterpart Japanese U.S. Appl. No. 18/576,066 dated Jan. 21, 2025, 10 pp.

* cited by examiner

PRIOR ART

PRIOR ART

PRIOR ART

SCREW PUMP WITH A TAPERED SUCTION-SIDE SECTION AND A PRESSURE-SIDE SECTION WITH A DECREASING CLEARANCE

This application is a national stage entry under 35 U.S.C. § 371 of International Application No. PCT/EP2022/068607, filed Jul. 5, 2022 and entitled "SCREW PUMP, SCREW ROTOR, METHOD OF MANUFACTURING A SCREW ROTOR, AND USE OF A SCREW PUMP OR A SCREW ROTOR," which claims the benefit of GB Application No. 2109851.2, filed Jul. 8, 2021 and entitled "SCREW PUMP, SCREW ROTOR, METHOD OF MANUFACTURING A SCREW ROTOR, AND USE OF A SCREW PUMP OR A SCREW ROTOR," the entire contents of each of which are incorporated herein by reference.

TECHNICAL FIELD

The disclosure relates to a screw pump, a screw rotor, a method of manufacturing a screw rotor and a use of a screw pump or a screw rotor.

BACKGROUND

Generally, a dry screw vacuum pump includes two screws with variable pitch and tapered design that run parallel to each other with small clearances. Gas flows in an axial direction from the inlet port to exhaust port. The pumped gases move axially towards the exhaust port by the spiralling motion of the screw. The pump may produce a high compression ratio across the pump and may result in smooth, gradual compression with deeper vacuum level. Dry screw vacuum pumps generally use no water or oil for sealing or lubrication in the vacuum stages.

SUMMARY OF THE INVENTION

Generally, screw vacuum pumps comprise a suction chamber in a housing, in which suction chamber two screw rotors are arranged. Each screw rotor comprises at least one displacement element with a helical recess formed by a helical protrusion. The helical protrusion preferably forms a plurality of windings. With screw vacuum pumps, particularly with screw fine vacuum pumps, it is often the goal is to achieve an internal volume ratio that is as high as possible. The internal volume ratio is the ratio of the volume at the inlet of the vacuum pump to the volume at the outlet of the vacuum pump. Screw vacuum pumps of the first generation, such as e.g. the pumps LEYBOLD Screwline or BUSCH Cobra, have an internal volume ratio of approx. 3 to 4. With vacuum pumps currently on the market, such as e.g. the screw vacuum pumps LEYBOLD DRYVAC or Edwards GKS, the volume ratio is 5 to 7.

There are basically two known rotor shapes for screw pumps: the parallel, also called cylindrical, rotor and the tapered, also called conical, rotor. For parallel rotors high volume ratio would lead to very small exhaust stages which are difficult to machine. Tapered rotors can be built with high geometrical volume ratio as the exhaust stage can be made small without having to machine small and deep grooves. The drawback is the limited number of the small exhaust stages that can be integrated in tapered rotors. In this case the back leakage through the clearances makes the exhaust stages inefficient in terms of compression and leaves the compression power at a high value.

To achieve low power consumption on screw pumps, two features may be desirable: high volume ratio, i.e. small exhaust stage, and a sufficient number of exhaust stages to compensate the back leakage. One way of achieving that is the "hybrid" rotor, which is a combination of a tapered rotor section on the inlet side and a parallel rotor section on the exhaust side of the pump. Such a rotor type is described, for example, in DE202017005336U1.

Thermal issues arise in such screw pumps. For example, during operation, e.g., with an inlet pressure between 100-300 mbar, seizures of the rotor with the housing, particularly with the stator, can occur. "Seizures" can also be referred to as "crashes". On the other hand, for example, the pumping efficiency of such screw pumps is relatively low.

It is an object of the disclosure to provide a screw pump preferably a screw vacuum pump, a screw rotor, a method of manufacturing a screw rotor and a use of a screw pump, preferably a screw vacuum pump, with a better seizure safety, particularly additionally with an optimized pumping efficiency.

Objects of the disclosure are achieved with a screw pump as defined by claim 1, a screw rotor as defined by claim 18, a method of manufacturing a screw rotor as defined by claim 19, and a use of a screw pump or screw rotor as defined by claim 21.

The screw pump of the disclosure preferably is a screw vacuum pump. More preferably, the screw pump of the disclosure is a dry running screw vacuum pump. The screw pump comprises a housing defining a chamber. Particularly the inner wall of the chamber corresponds to a stator of the screw pump. The screw pump further comprises two screw rotors. Each screw rotor comprises a rotor shaft, and at least two displacement elements connected with the rotor shaft. Each displacement element has at least one helical protrusion. Preferably, the helical protrusion comprises multiple windings. The helical protrusion particularly forms a helical recess therebetween. One of the displacement elements is a suction-side displacement element arranged in a suction-side section of the chamber. Another one of the displacement elements is a pressure-side displacement element arranged in a pressure-side section of the chamber. The suction-side displacement element is designed tapering in the conveying direction. The clearance between the pressure-side displacement element and the pressure-side section of the chamber decreases in the conveying direction. The clearance is a radial clearance. This pressure-side section of the chamber particularly is a pressure side stator element. The clearance between the pressure-side displacement element and the pressure-side section of the chamber decreases at least partly, preferably over the entire length between the pressure-side displacement element and the pressure-side section of the chamber. It is preferred that the clearance between the pressure-side displacement element and the pressure-side section of the chamber decreases at least in the inlet area of the pressure-side displacement element. The inlet area of the pressure-side displacement element is the suction-side area of the pressure-side displacement and the pressure-side section of the chamber. An outlet area is on the opposite site in the conveying direction. It is preferably possible that the clearance between the pressure-side displacement element and the pressure-side section of the chamber is constant, particularly the same, in the outlet area. It was found that the inlet area, particularly the inlet section of the pressure-side displacement element and/or the inlet section of the pressure-side section of the chamber has a high temperature during operation, particularly the highest temperature of the area of the displacement element, or even of the entire screw pump. Particularly, for inlet pressures between 100-300 mbar such high temperatures can be observed. Such high temperatures can lead to thermal expansion of the pressure-side displacement element, particularly of the helical protrusion. It was found that the greatest expansion is in the inlet area of the pressure-sided displacement element. Thus, with the present disclosure, it is possible to achieve a optimize, preferably a constant, clearance during operation, since the thermal expansion can compensate the different clearances.

It is preferred that the clearance between the pressure-side displacement element and the pressure-side section of the chamber is adjusted such that during operation, particularly during operation in the 100-300 mbar inlet pressure region, an essentially uniform gap between the between the pressure-side displacement element and the pressure-side section of the chamber is formed.

Preferably, the diameter of the pressure-side displacement element increases in the conveying direction. It is preferred that the diameter increases at least partly, preferably over the entire length of the pressure-side displacement element, i.e. from the inlet to the outlet of the pressure-side displacement element. The diameter preferably is a radial diameter of the pressure-side displacement.

Preferably, the pressure-side displacement element is designed counter-conical to the suction-side displacement element. It is preferred that pressure-side displacement element is designed at least partly counter-conical, preferably over the entire length of the pressure-side displacement element, i.e. from the inlet to the outlet of the pressure-side displacement element.

Preferably, the clearance between the pressure-side displacement element and the pressure-side section of the chamber at least partly decreases linearly in the conveying direction, particularly over the entire length of the pressure-side displacement element, i.e. from the inlet to the outlet of the pressure-side displacement element.

Preferably, the radial clearance, particularly at the inlet are, between the pressure-side displacement element and the pressure-side section of the chamber is 100 μm to 500 μm, preferably 130 μm to 450 μm, more preferably 150 μm to 400 μm. It is preferred that the radial clearance between the pressure-side displacement element and the pressure-side section of the chamber decreases by 20 μm to 150 μm, particularly over the entire length of the pressure-side displacement element, i.e. from the inlet to the outlet of the pressure-side displacement element.

Preferably, the clearance between the pressure-side displacement element and the pressure-side section of the chamber decreases by 10% to 50%, particularly by 15% to 30% in the conveying direction. This decrease particularly defines a decrease over the entire length of the pressure-side displacement element, i.e. from the inlet to the outlet of the pressure-side displacement element.

Preferably, the diameter of at least one of the helical protrusions of the pressure-side displacement element increases in the conveying direction. In other words, it is preferred that the helical protrusion has a conical shape. The diameter of the helical protrusion preferably is a radial diameter.

Preferably, the diameter of the at least one helical protrusion of the pressure-side displacement element increases by 0.05% to 0.5%, particularly by 0.05% to 0.2% in the conveying direction. This increase particularly defines an increase over the entire length of the pressure-side displacement element, i.e. from the inlet to the outlet of the pressure-side displacement element.

Preferably, the diameter of the at least one helical protrusion of the suction-side displacement element decreases by 3% to 40%, particularly by 5% to 30%, more particularly by 15% to 30% in the conveying direction. This decrease particularly defines a decrease over the entire length of the suction-side displacement element, i.e. from the inlet to the outlet of the suction-side displacement element.

Preferably, the incline of the, particularly conical, pressure-side displacement element is smaller than the incline of the, particularly conical, suction-side displacement element. It is preferred that the incline of the suction-side displacement element is 2° to 8°. Preferably, the incline of the pressure-side displacement element is 0.01° to 1°, particularly 0.050 to 1°, more particularly 0.050 to 0.5°.

As an alternative to the increasing diameter of one or more of the helical protrusions of the pressure-side displacement element, it is possible that one or more helical protrusions of the pressure-side displacement element has a constant diameter, i.e. a cylindrical shape.

Preferably, the inner diameter of the pressure-side section of the chamber decreases in the conveying direction. This pressure-side section of the chamber corresponds to the stator for the pressure-side displacement element. The decreasing inner diameter of the pressure-side section of the chamber can be implemented, at least partly, preferably end-to-end, in a linear or curved manner.

Preferably, the inner volume ratio of the screw pump is at least 4, particularly at least 7.

Preferably, the diameter of an inner element of the suction-side displacement element increases, at least partly, particularly end-to-end, in the conveying direction. It is preferred that the inner element increases in a conical manner. This inner element preferably is part of the rotor shaft.

Preferably, the diameter of an inner element of the pressure-side displacement element is essentially constant. In other words, the inner element of the pressure-side displacement element has the same diameter, particularly end-to-end. This inner element preferably is part of the rotor shaft.

Preferably, each displacement element has at least one helical recess. It is preferred that the helical recess is formed by the helical protrusion, particularly between windings of the helical protrusion.

Preferably, the volume of the helical recess of the suction-side displacement element is greater than the volume of the helical recess of the pressure-side displacement element.

Preferably, the displacement elements have substantially the same diameter at the end faces directed towards each other.

Preferably, the diameter, particularly the average or maximum diameter, of the pressure-side displacement element is smaller by 5-35%, particularly by 10-25%, than the inlet diameter of the suction-side displacement element.

Preferably, the suction-side displacement element has a volume ratio of at least 4, particularly at least 7.

Preferably, the pressure-side displacement element has a volume ratio of 1 to 3, particularly of 1 to 1.5, more particularly of 1.0001 to 1.1.

Preferably, the diameter of the pressure-side displacement element is 70 mm to 200 mm.

Preferably, the diameter of the suction-side displacement element is 80 to 300 mm in the region of the pump inlet.

Preferably, the diameter of the suction-side displacement element is 65 to 180 mm in the transition region to the pressure-side displacement element. The transition region corresponds to the outlet region of the suction-side displacement element.

Preferably, the diameter of the pressure-side displacement element is 65 to 180 mm in the region of the outlet of the pump and/or outlet of the pressure-side displacement element.

Preferably, the number windings of the helical protrusion of the pressure-side displacement element is at least 3, particularly at least 5, more particularly at least 8. Preferably, the number of gaps between the windings of the pressure-side displacement element is at least 2, particularly at least 4, more particularly at least 7.

Preferably, the number of windings of the helical protrusion of the suction-side displacement element is 3 to 6. Particularly, the number of gaps between the windings of the suction-side displacement element is 2 to 5.

Preferably, a further displacement element is provided that is arranged upstream of the suction-side displacement element in the flow direction, the further displacement element being preferably substantially cylindrical in shape.

The present disclosure further discloses a screw rotor for a screw pump. Preferably, the screw rotor of the disclosure is a screw rotor for a screw vacuum pump, more preferably for a dry running screw vacuum pump. The screw rotor comprises a rotor shaft and at least two displacement elements connected with the rotor shaft. Each displacement element having at least one helical protrusion. Preferably, the helical protrusion comprises a plurality of windings. One of the displacement elements is a suction-side displacement element. Another one of the displacement elements is a pressure-side displacement element. The suction-side displacement element is designed tapering in the conveying direction. The diameter of the pressure-side displacement element increases in the conveying direction. The suction-side displacement element is preferably adapted to be arranged in a suction-side section of a chamber of the screw pump. The pressure-side displacement element is preferably adapted to be arranged in a pressure-side section of the chamber of the screw pump.

Preferably, the screw rotor for a screw pump comprises one or more features as defined for the above screw pump of the present disclosure.

Preferably, the screw rotor for a screw pump is a screw rotor for the above defined screw pump.

The present disclosure further discloses a method of manufacturing a screw rotor for a screw pump. Preferably, the method is a method of manufacturing a screw rotor for a screw vacuum pump, more preferably for a dry running screw vacuum pump. The method comprises the step of providing a screw rotor. The provided screw rotor comprising a rotor shaft and at least two displacement elements connected with the rotor shaft. Each displacement element having at least one helical recess. Preferably, the helical protrusion comprises multiple windings. One of the displacement elements is a suction-side displacement. Another one of the displacement elements is a pressure-side displacement element. The pressure-side displacement element is designed substantially cylindrically. Another step of the method comprises machining the pressure-side displacement element to achieve an increasing diameter of the pressure-side displacement element in the conveying direction.

Preferably, the machining is performed in such a way to achieve a pressure-side displacement element with one or more features as defined for the above pressure-side displacement element of the screw pump of the present disclosure.

Preferably, the machining is performed by means of turning, and/or milling, and/or grinding.

The present disclosure further discloses a method of manufacturing a screw pump. Preferably, the method is a method of manufacturing a screw vacuum pump, more preferably a dry running screw vacuum pump. The method comprises the steps of the above defined method of manufacturing a screw rotor for a screw pump. Another preferred step of the method is to arrange at least one, preferably two screw rotors manufactured with the steps of the of the above defined method of manufacturing a screw rotor for a screw pump inside a housing of a pump.

The present disclosure further discloses a use of a screw pump as defined above to generate a vacuum, or the use of a above defined screw rotor, particularly of two of the above defined screw rotors, in a screw pump, preferably in a screw vacuum pump (100), more preferably in a dry running screw vacuum pump (100), to generate a vacuum.

BRIEF DESCRIPTION OF DRAWINGS

The disclosure will be explained hereinafter in more detail with reference to preferred examples and to the accompanying drawings.

DETAILED DESCRIPTION

Similar or identical components or elements are identified with the same reference signs or variations thereof (e.g. 51 and 51*a*-51*e*) in the figures.

Figure 1:
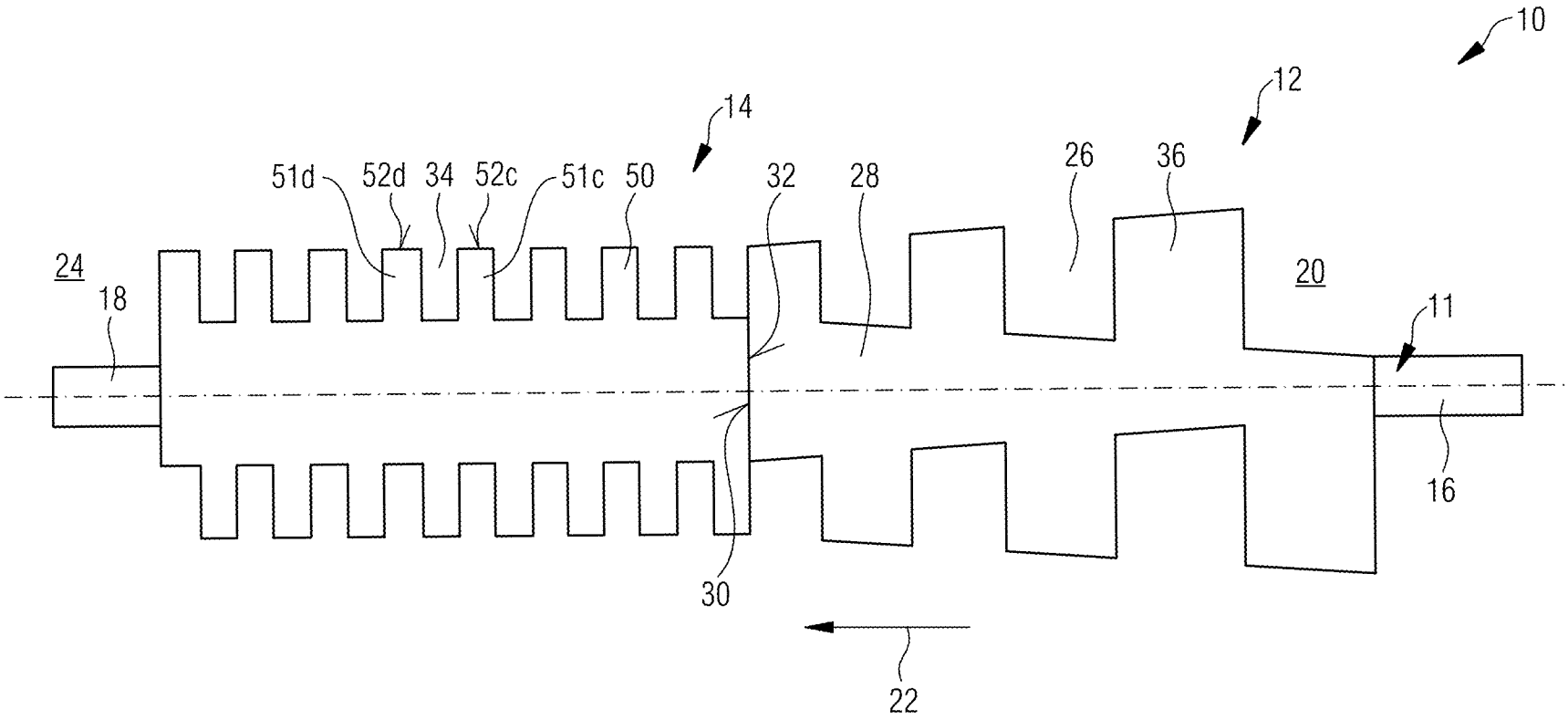
FIG. 1 a schematic side view of a screw rotor of the state of the art.

The screw rotor 10 illustrated in FIG. 1 preferably corresponds to the screw rotor of DE202017005336U1. The screw rotor 10 comprises a rotor shaft 11 supporting two displacement elements 12, 14. The two cylindrical ends 16, 18 of the rotor shaft serve to receive bearings for supporting the screw rotor in a pump housing. It is also possible to support the rotor shaft in an overhung manner, i.e. on one side.

The displacement element 12 on the right in FIG. 1 is conical and tapers in the conveying direction 22 from a pump inlet 20 which is arranged on the right in FIG. 1 but not illustrated therein, towards a pump outlet 24 which is arranged on the left in FIG. 1 but not illustrated therein.

The helical recess 26 of the conical suction-side displacement element 12 is designed such that the volume decreases. This is achieved on the one hand due to the conical outer shape of the displacement element 12. The conical outer shape of the displacement element 12 is achieved by a decreasing diameter of the helical protrusion 36 of the displacement element (see also FIG. 3). On the other hand, the decreasing volume is achieved due to the inner portion 28 of the displacement element 12 widening in the conveying direction (see also FIG. 3). Individual chamber volumes formed by the two meshing screw rotors thus reduce their respective volume in the conveying direction 22.

In the example illustrated in which only two displacement elements 12, 14 are provided, an end face 30 of the displacement element 12, which is directed towards the pump outlet 24 or towards the pressure side of the pump, abuts on an end face 32 of the pressure-side displacement element 14. The end face 32 is directed towards the pump inlet or in the direction of the suction side of the vacuum pump. The diameters of the two displacement elements 12, 14 are preferably substantially the same in the region of the end faces 30, 32.

In FIG. 1, the pressure-side displacement element 14 has a cylindrical shape. The pressure-side displacement element 14 also has a helical protrusion 36 forming a helical recess 34.

Due to the recess 34 eight windings are formed in the pressure-side displacement element 14 in the example illustrated.

Figure 2:
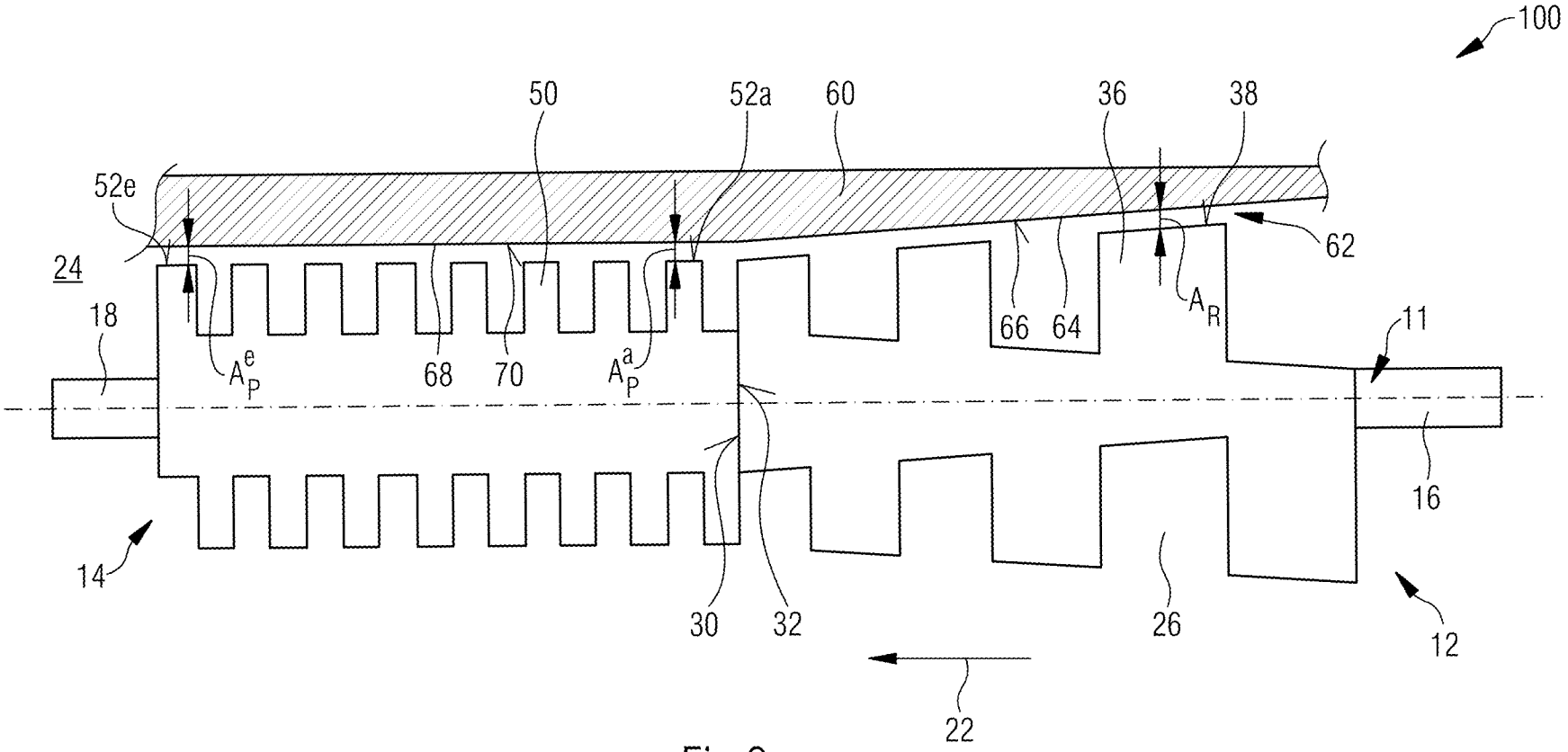
FIG. 2 a schematic cutaway side view of a section of a screw vacuum pump of the state of the art.

FIG. 2 shows a schematic cutaway side view of a section of a screw vacuum pump 100 with the screw rotor 10 of FIG. 1.

Only one screw rotor 10 of the screw vacuum pump 100 and a section of a wall 60 of a housing of the vacuum pump 100 is shown. The housing forms a chamber 62 within.

The right section of the shown wall 60 corresponds to the suction-side section 64 of the chamber 62, which forms the stator for the suction-side displacement element 12. On the other hand, the left section of the shown wall 60 corresponds to the pressure-side section 68 of the chamber 62, which forms to the stator for the pressure-side displacement element 14.

The clearance between the suction-side displacement element 12 and the suction-side section 64 of the chamber 62 corresponds to distance $A_R$ between the outer surface 38 of the helical protrusion 36 of the suction-side displacement element 12 and the inner surface 66 of the suction-side section 64 of the chamber 62. Preferably, the distance $A_R$ is constant, i.e. the distance $A_R$ hast the same value for the entire suction-side displacement element 12.

The clearance between the pressure-side displacement element 14 and the pressure-side section 68 of the chamber 62 is constant. Thus, the distance $A_P^a$ between the outer surface $52_a$ at winding $51_a$ of the helical protrusion 50 at the right side of the pressure-side displacement element 14 and the inner surface 70 of the suction-side section 68 of the chamber 62 is the same as the distance $A_P^e$ between the outer surface $52_e$ at the winding $51_e$ of the helical protrusion 50 at the left side of the pressure-side displacement element 14 and the inner surface 70 of the suction-side section 68 of the chamber 62. Preferably, the distances $A_R$ as well as $A_P^e$ and $A_P^a$ are the same.

For the screw pump with a screw rotor 10 as illustrated in FIGS. 1-2, when running at low inlet pressure the compression is mainly done in the pressure-side displacement element 14 which gives the low power consumption for the screw pump. But when operating, for example in the 100-300 mbar range, the compression is done in the tapered suction-side displacement element 12 and the gas reaches atmospheric pressure before entering the pressure-side displacement element 14. The pressure-side displacement element 14 does not contribute to the compression and only convey the gas while acting as rotating cooling fins, i.e. they cool both gas and rotor. When running at low inlet pressure the power consumption is low and rotor temperature is also low. During operation, for example with an inlet pressure between 100-300 mbar, the compression power is high and the compression is done in the tapered suction-side displacement element 12. This causes a high-power density in this region and consequently leads to high rotor temperatures.

Challenging in terms of the clearances is the temperature profile of the pump 100. When running at low inlet pressure the power consumption is low due to the high volume ratio and rotor temperature is also low. This causes a relatively small thermal reduction of radial clearances. But, for example, for inlet pressures between 100-300 mbar the compression power is high and the compression is done in the tapered suction-side displacement element 12. This causes a high power density in this region and consequently leads to high rotor temperatures and a high thermal reduction of the radial clearances, particularly in the transition area between the displacement element 12 and the pressure-side displacement element 14.

Figure 7:
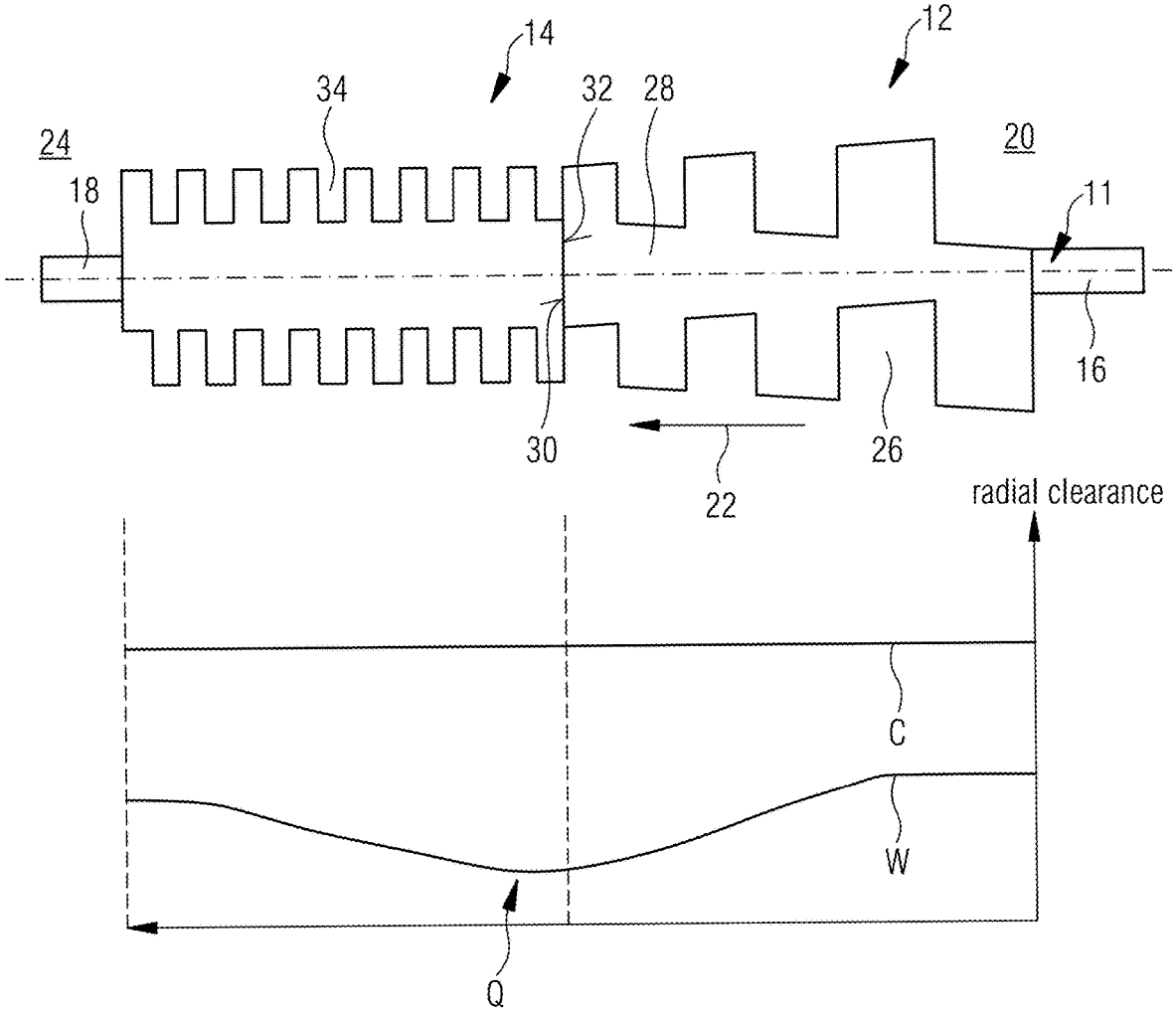
FIG. 7 a graph showing the radial clearance of a screw vacuum pump of the state of the art.

The impact of the changing radial clearances based on the thermal effect for the vacuum pump 100 of FIGS. 1-2 are shown in FIG. 7.

The graph at the bottom of FIG. 7 shows the radial clearance over the length of the screw rotor 10.

Curve C shows the clearance in the cold condition. In the cold condition, the clearance is constant. Preferably, the clearance corresponds to $A_P^e=A_P^a=A_R$.

Curve W shows the clearance in the warm condition, preferably at an inlet pressure of 100-300 mbar, particularly at 200 mbar. In the warm condition, the clearance decreases of the length of the screw rotor 10 in the conveying direction, whereby a minimum clearance is reached in area Q. A bulge in the clearance can be found in this area Q. This reduced clearance poses a seizure risk.

It was found that the radial clearance may have relatively higher priority compared to other clearances for the performance of the pump. It should be as small as possible but allow safe operation of the pump under all conditions including the 100-300 mbar region where the rotor reaches the highest temperature. Thus, the radial clearance may be designed for this operating region.

Figure 3:
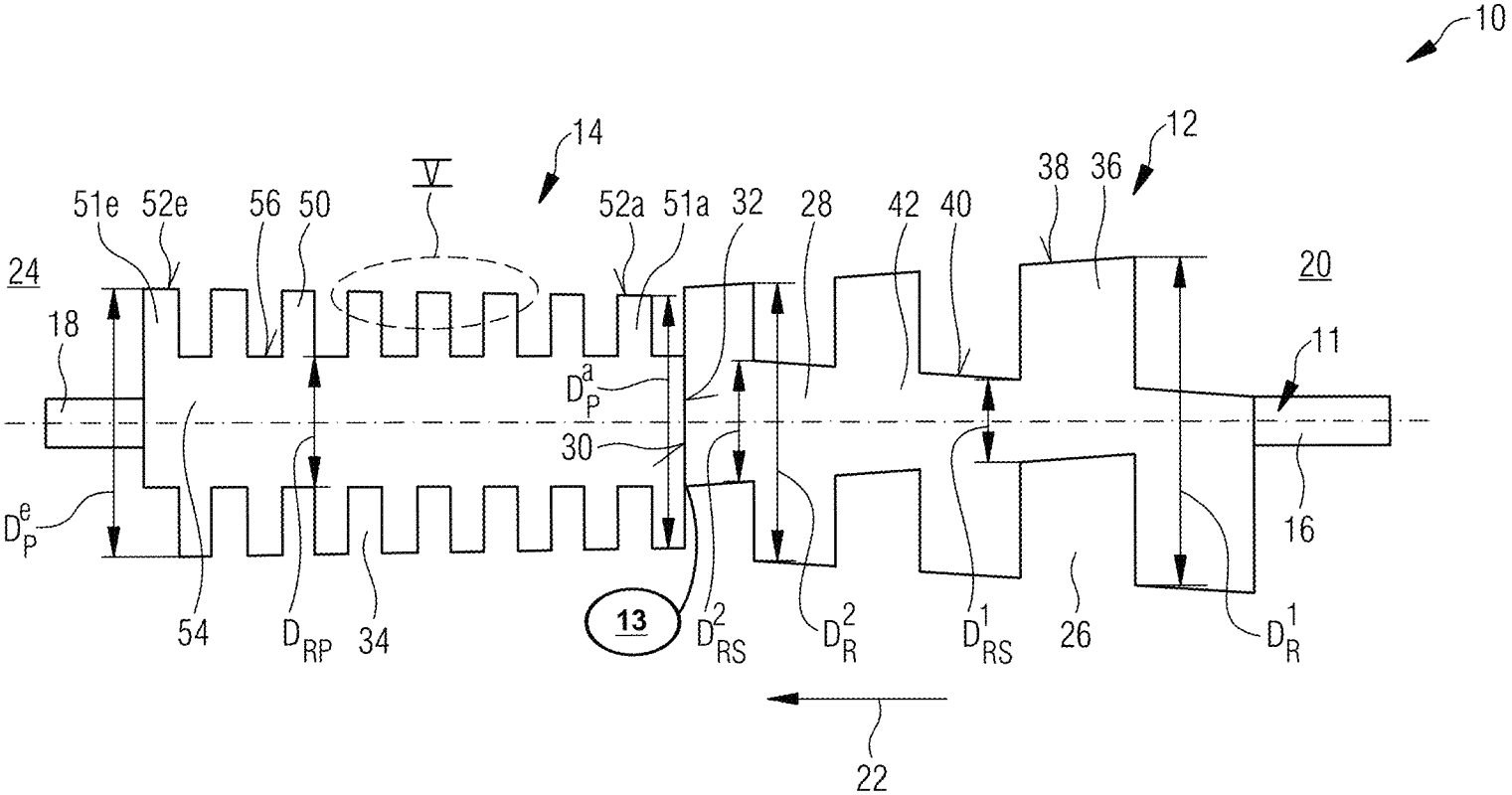
FIG. 3 a schematic side view of an example of a screw rotor according to the disclosure.
Figure 4:
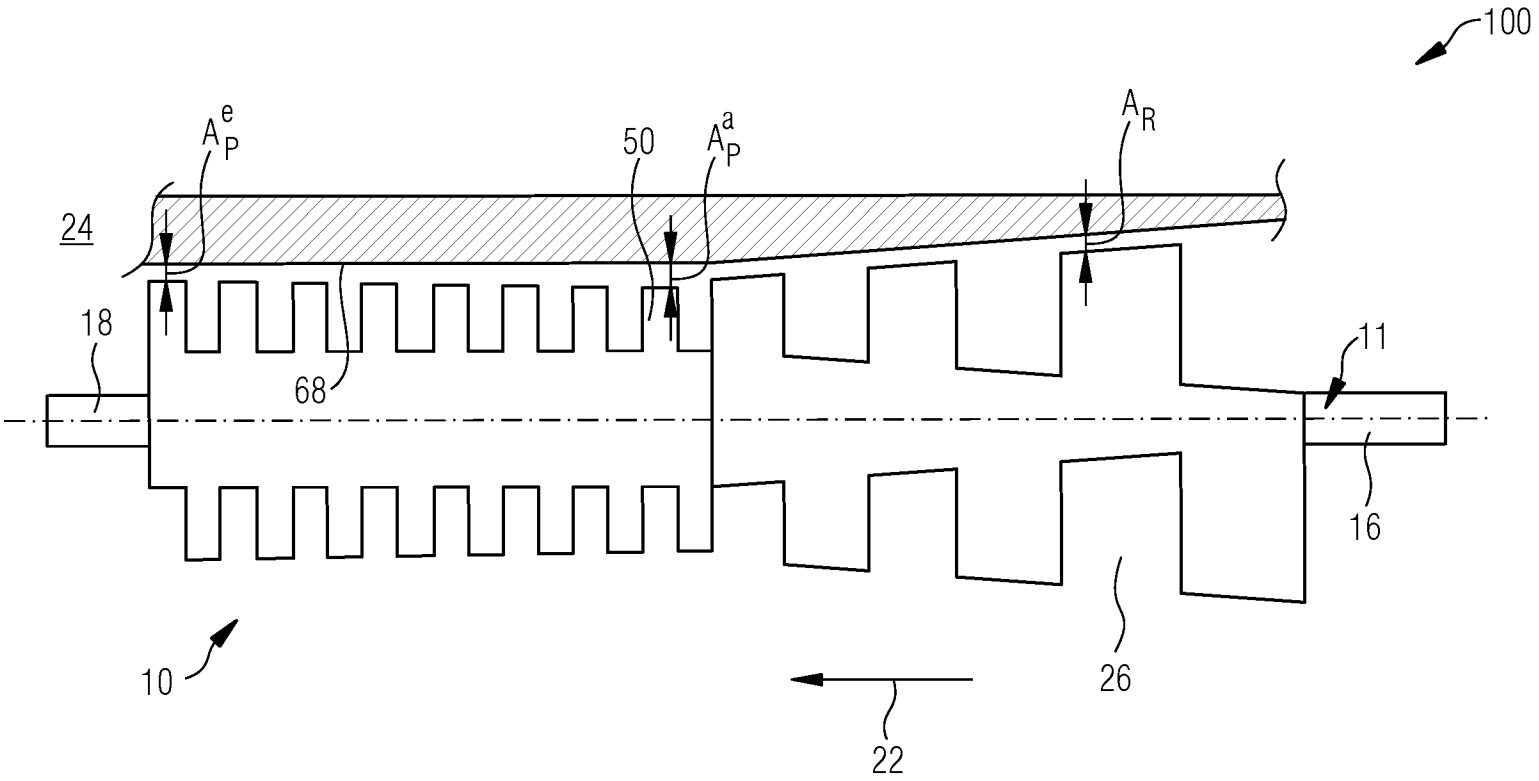
FIG. 4 a schematic cutaway side view of a section of an example of a screw vacuum pump according to the disclosure.

FIG. 3 shows an example of a screw rotor 10 according to the present disclosure.

The example is based on the screw rotor 10 of FIG. 1.

In contrast to the screw rotor 10 of FIG. 1, the screw rotor 10 of FIG. 3 shows a pressure-side displacement element 14 having a helical protrusion 50 with a counter-conical shape compared to the suction-side displacement element 12. In detail, the diameter of the pressure-side displacement element 14 increases in the conveying direction 22. As indicated, the diameter $D_P^a$ at the inlet area of the suction-side displacement element 12 is smaller than the diameter $D_P^e$ at the outlet area of the suction-side displacement element 12. The diameter $D_P^a$ of the helical protrusion 50 is determined at winding 51*a*, whereas the diameter $D_P^e$ of the helical protrusion 50 is determined at winding 51*e*.

Preferably, the diameter of the helical protrusion 50 of the pressure-side displacement element 14 increases by 0.05% to 0.5%, particularly by 0.05% to 0.2% in the conveying direction. This increase particularly defines an increase over the entire length of the pressure-side displacement element 14, i.e. from the inlet to the outlet of the pressure-side displacement element 14.

As for FIG. 1, the inner diameter $D_{RP}$ of the pressure-side displacement element 14, which corresponds to the outer diameter of the inner element 54 of the pressure-side displacement element 14 or the diameter of the helical recess 34 is preferably constant for the pressure-side displacement element 14. Thus, the diameter $D_{RP}$ has the same value over the entire length of the pressure-side displacement element 14 in the conveying direction 22.

Also, the inner and outer diameter of the suction-side displacement element 12 in FIG. 3 are the same as for FIG. 1. The diameter at the inlet area of the suction-side displacement element 12 is smaller than the diameter at the outlet area of the suction-side displacement element 12. Exemplary, the diameter DR at a first area on the right side of the helical protrusion 36 is indicated, which is greater than the diameter DR at a second area on the left side of the helical protrusion 36. The inner diameter of the suction-side displacement element 12, which corresponds to the outer diameter of the inner element 42 of the suction-side displacement element 12 or the diameter of the helical recess 26 preferably increases in the conveying direction 22. Exemplary, the diameter $D_{RS}^1$ at a first area on the right side of the helical recess 26 is indicated, which is smaller than the diameter $D_{RS}^2$ at a second area on the left side of the helical recess 26.

FIG. 3 shows an example of a screw vacuum pump 100 according to the present disclosure. The screw rotor 10 of the example corresponds to the screw rotor 10 of FIG. 3.

The right side of FIG. 3, i.e. the section of the suction-side displacement element 12, corresponds to the example of FIG. 2. In some examples, as illustrated in the middle of FIG. 3, a further displacement element 13 is provided that is arranged upstream of the suction-side displacement element 12 in the conveying direction 22. The further displacement element 13 may be substantially cylindrical in shape.

On the left side, i. e. the section of the pressure-side displacement element 14, due to the increasing diameter of the helical protrusion 50 of the pressure-side displacement element 14, the clearance between the pressure-side displacement element 14 and the pressure-side section of the chamber 68 decreases in the conveying direction 22. This is indicated by the distance $A_P^a$ between the helical protrusion 50 and the pressure-side section 68 of the chamber 62 at an area on the right side of the pressure-side displacement element 14, which is greater than the distance $A_P^e$ between the helical protrusion 50 and the pressure-side section 68 of the chamber 62 at an area on the left side of the pressure-side displacement element 14.

Preferably, the clearance between the pressure-side displacement element 14 and the pressure-side section 68 of the chamber 62 decreases by 10% to 50%, particularly by 15% to 30% in the conveying direction 22. This decrease particularly defines a decrease over the entire length of the pressure-side displacement element 14, i.e. from the inlet to the outlet of the pressure-side displacement element 14.

Figure 5A:
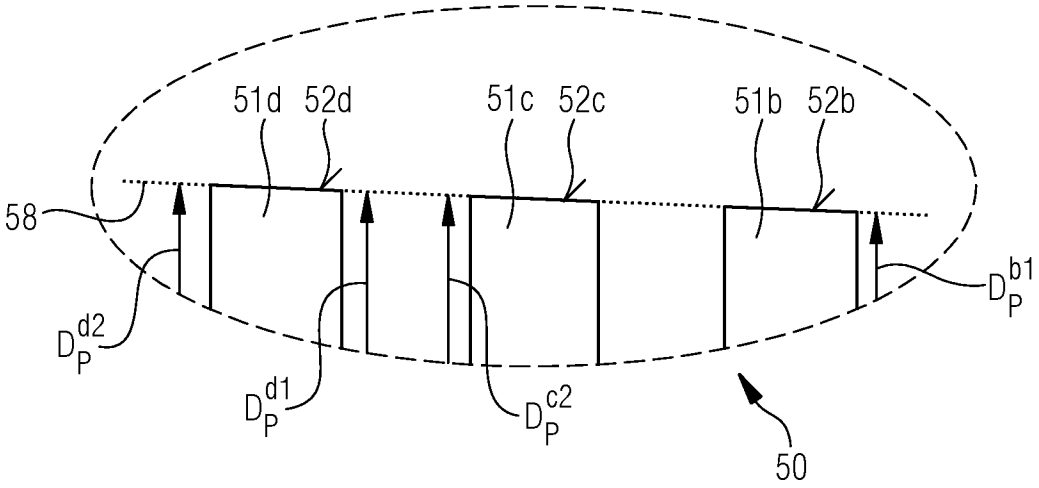
FIG. 5*a*-5*b* schematic detail side views of examples based on the detail section V of FIG. 3.

FIG. 5*a* shows a detail side view of section V of FIG. 3.

As indicated by the inclined reference line 58, the helical protrusion 50 of the pressure-side displacement element 14 increases in diameter in the conveying direction. Here, as illustrated, a linear increase is implemented.

The diameter $D_P^{d2}$ on the left side of the left winding 51*d* is greater than the diameter $D_P^{d1}$ on the right side of the left winding 51*d*. The minimum diameter $D_P^{d1}$ of the left winding 51*d* is greater than the maximum diameter $D_P^{c2}$ of the middle winding 51*c*.

The diameters are measured between the outer surfaces 51*d*, 51*c*, 51*b* of the helical protrusion 50, whereby the outer surfaces on the other side of the helical protrusion 50 are not shown in FIG. 5*a*.

Figure 5B:
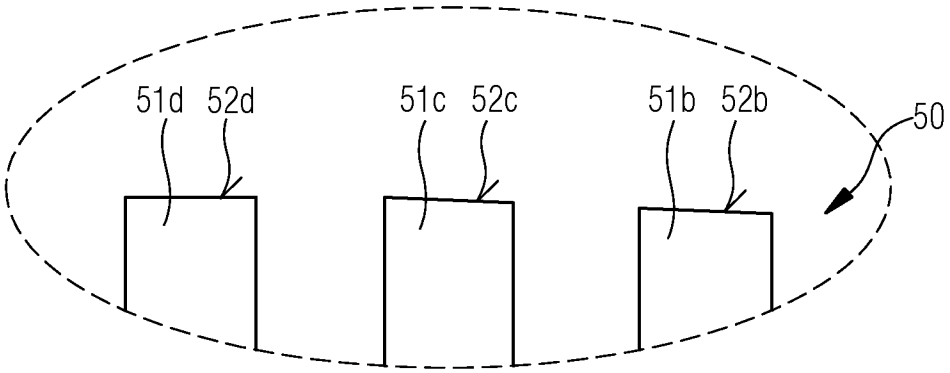

FIG. 5*b* shows an alternative example of the pressure-side displacement element 14 based on the FIG. 5*a*.

The right winding 51*b* and middle winding 51*c* of the helical protrusion 50 have an increasing diameter in the conveying direction, as also implemented in FIG. 5*a*. Thus, particularly, the surfaces 52*b*, 52*c* of the windings 51*b*, 51*c* have a conical form.

The left winding 51*d* of the helical protrusion 50 however has a cylindrical form, thus a constant diameter. In this example, only a section of the helical protrusion 50 has an increasing diameter. In other words, the diameter of the helical protrusion 50 increases partly over the length of the pressure-side displacement element 14.

Figure 6:
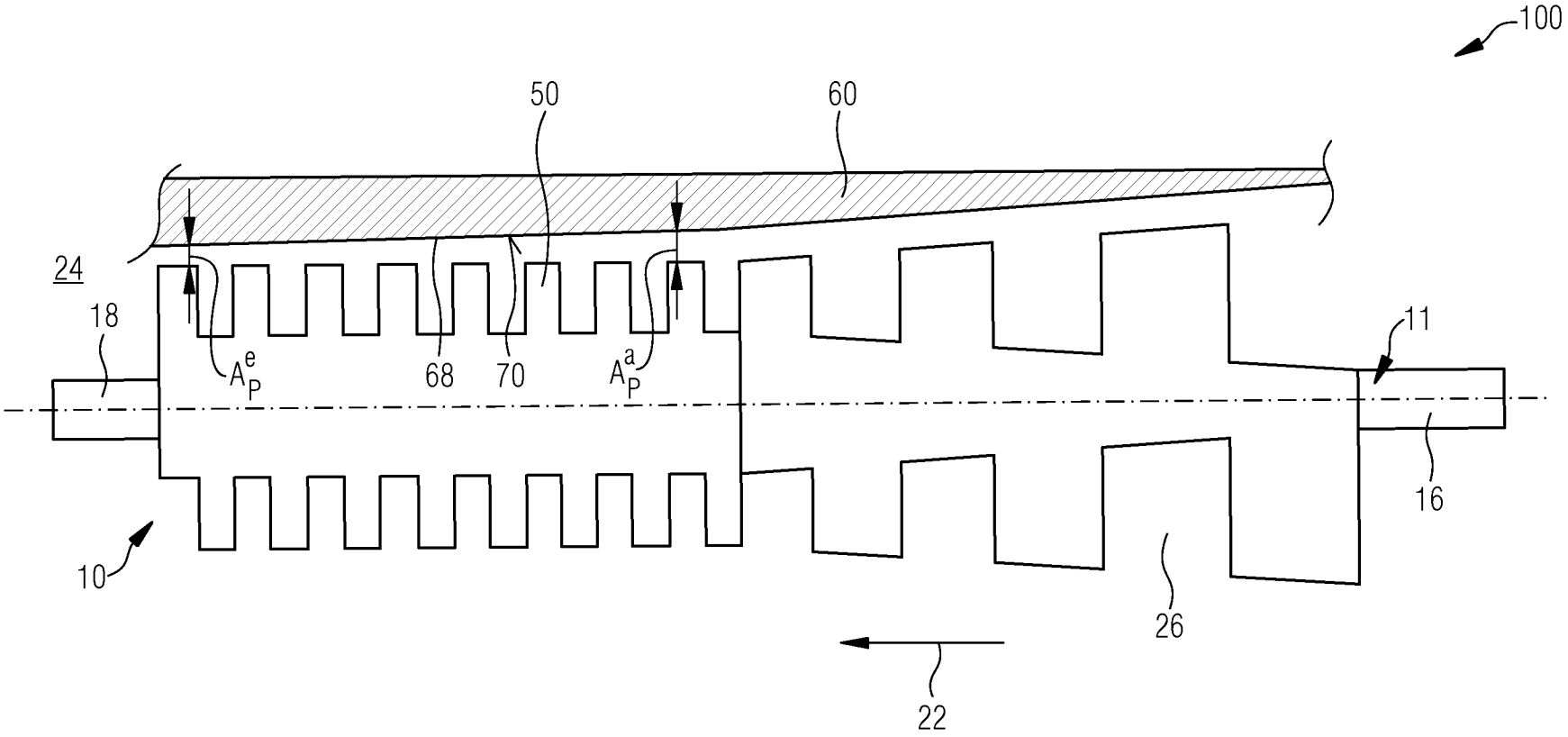
FIG. 6 a schematic cutaway side view of a section of another example of a screw vacuum pump according to the disclosure.

FIG. 6 shows another example of a screw vacuum pump 100 according to the present disclosure. The screw rotor 10 of the example corresponds to the screw rotor 10 of FIG. 1.

The wall 60 of the housing of the screw vacuum pump 100 is based on the example of FIG. 2. However, in contrast to FIG. 2, the pressure-side section 68 of the chamber 62 has an inner diameter which decreases in the conveying direction 22.

The clearance between the pressure-side displacement element 14 and the pressure-side section 68 of the chamber 62 again decreases in the conveying direction 22. The distance $A_P^a$ between the helical protrusion 50 and the pressure-side section 68 on the right side is greater than the distance $A_P^e$ between the helical protrusion 50 and the pressure-side section 68 on the left side.

In the shown examples a constant pitch for the changing diameter of the helical protrusion 36 and/or the helical protrusion 50 is implemented. However, it is possible to have a changing pitch, for example an increasing or decreasing pitch in the conveying direction 22.

The examples only show one screw rotor 10. It is preferred that the screw pump of the present disclosure has a second screw rotor, preferably identical in terms of the clearance to the screw rotor 10 as defined here.

The screw rotor 10 of the examples is a screw rotor 10 for a screw vacuum pump, preferably for a dry running screw vacuum pump. However, it is also possible that the screw rotor 10 of the present disclosure, particularly as shown in the figures is a screw rotor 10 for a general screw pump. The screw pump 100 of the examples is a screw vacuum pump 100, preferably a dry running screw vacuum pump 100. However, it is also possible that the screw pump 100 of the present disclosure, particularly as shown in the figures is a general screw pump.

Figure 8:
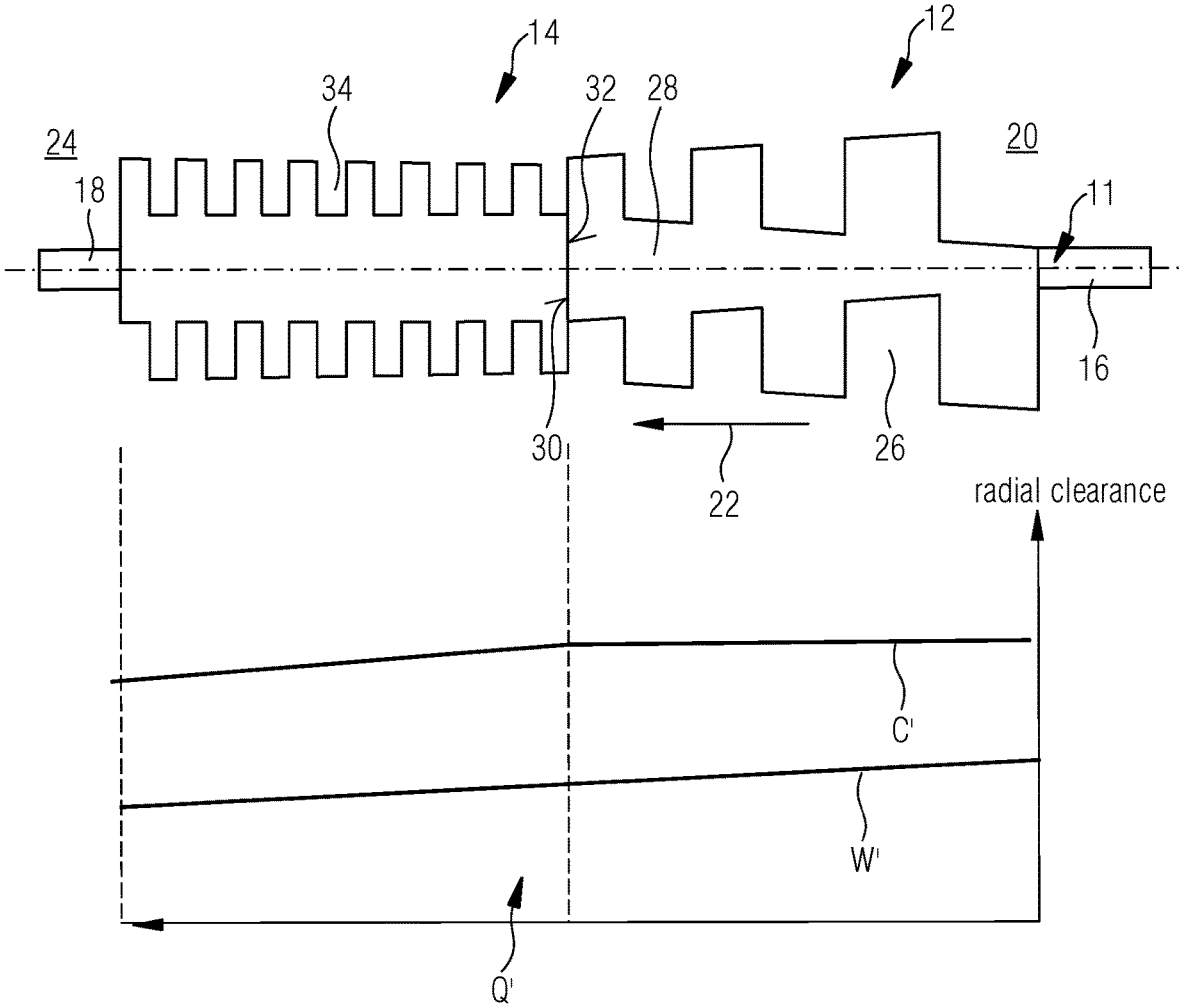
FIG. 8 a graph showing the radial clearance of an example of a screw vacuum pump according to the disclosure.

FIG. 8 shows the effect of the decreasing clearance between the pressure-side displacement element 14 and the pressure-side section 68 of the chamber 62, according to the disclosure.

The graph at the bottom of FIG. 8 shows the radial clearance over the length of the screw rotor 10 of FIG. 3.

Curve C' shows the clearance in the cold condition.

Curve W' shows the clearance in the warm condition, preferably at an inlet pressure of 100-300 mbar, particularly at 200 mbar. In the warm condition, the clearance decreases of the length of the screw rotor 10 in the conveying direction.

In contrast to the pronounced clearance drop (area Q) in the vacuum pumps of the state of the art (see FIG. 7), the screw rotor 10 and/or screw vacuum pump 100 according to the present disclosure shows an essentially constant change in the clearance, particularly in area Q'.

Thus, the seizure risk can be reduced. On the other hand, with the present disclosure it is possible to optimize, particularly minimize, the radial clearance to achieve an optimal pumping efficiency.

The invention claimed is:

1. A screw pump comprising a housing comprising a wall, the housing defining a chamber and two screw rotors, wherein each screw rotor comprises:

a rotor shaft, and at least two displacement elements connected with the rotor shaft, each displacement element having at least one helical protrusion, wherein one of the displacement elements is a suction-side displacement element arranged in a suction-side section of the chamber, and wherein another one of the displacement elements is a pressure-side displacement element arranged in a pressure-side section of the chamber, wherein the suction-side displacement element is designed tapering in a conveying direction, and wherein the clearance between the pressure-side displacement element and the pressure-side section of the chamber at least partly decreases in the conveying direction.

2. The screw pump of claim 1, wherein the clearance between the pressure-side displacement element and the pressure-side section of the chamber is such that during operation in the 100-300 mbar region, a gap between the between the pressure-side displacement element and the pressure-side section of the chamber is formed.

3. The screw pump of claim 1, wherein the diameter of the pressure-side displacement element increases in the conveying direction.

4. The screw pump of claim 1, wherein the pressure-side displacement element is designed counter-conical to the suction-side displacement element.

5. The screw pump of claim 1, wherein the clearance between the pressure-side displacement element and the pressure-side section of the chamber at least partly decreases linearly in the conveying direction.

6. The screw pump of claim 1, wherein the clearance between the pressure-side displacement element and the pressure-side section of the chamber decreases by 10% to 50%, in the conveying direction.

7. The screw pump of claim 1, wherein the diameter of the at least one helical protrusion of the pressure-side displacement element increases in the conveying direction.

8. The screw pump of claim 7, wherein the diameter of the at least one helical protrusion of the pressure-side displacement element increases by 0.05% to 0.5% in the conveying direction.

9. The screw pump of claim 1, wherein the inner diameter of the pressure-side section of the chamber decreases in the conveying direction.

10. The screw pump of claim 1, wherein an inner volume ratio of the screw pump is at least 4.

11. The screw pump of claim 1, wherein the suction-side displacement element has a volume ratio of at least 4.

12. The screw pump of claim 1, wherein the pressure-side displacement element has a volume ratio of 1 to 3.

13. The screw pump of claim 1, wherein the diameter of an inner element of the suction-side displacement element increases in the conveying direction.

14. The screw pump of claim 1, wherein the diameter of an inner element of the pressure-side displacement element is essentially constant.

15. The screw pump of claim 1, wherein each displacement element has at least one helical recess.

16. The screw pump of claim 15, wherein the volume of the helical recess of the suction-side displacement element is greater than the volume of the helical recess of the pressure-side displacement element.

17. The screw pump of claim 1, wherein a further displacement element is provided that is arranged upstream of the suction-side displacement element in the conveying direction, the further displacement element being substantially cylindrical in shape.

18. A screw rotor for a screw pump comprising:

a rotor shaft, and at least two displacement elements connected with the rotor shaft, each displacement element having at least one helical protrusion, wherein one of the displacement elements is a suction-side displacement element, and wherein another one of the displacement elements is a pressure-side displacement element, wherein the suction-side displacement element is designed tapering in a conveying direction, and wherein the diameter of the pressure-side displacement element increases in the conveying direction.

19. A method of manufacturing a screw rotor for a screw pump comprising:

providing a screw rotor, the screw rotor comprising a rotor shaft, and at least two displacement elements connected with the rotor shaft, each displacement element having at least one helical recess, wherein one of the displacement elements is a suction-side displacement element, wherein the suction-side displacement element is designed tapering in a conveying direction, wherein another one of the displacement elements is a pressure-side displacement element, wherein the pressure-side displacement element is designed substantially cylindrically; and machining the pressure-side displacement element to have an increasing diameter in the conveying direction.

20. The method of claim 19, wherein the machining is performed by means of turning, and/or milling, and/or grinding.

21. A method of manufacturing a screw pump comprising:

providing a screw rotor comprising at least two displacement elements, wherein one of the displacement elements is a suction-side displacement element, wherein the suction-side displacement element is designed tapering in a conveying direction, wherein another one of the displacement elements is a pressure-side displacement element;

machining the pressure-side displacement element to have an increasing diameter in the conveying direction; and arranging the screw rotor inside a housing.

* * * * *